US011408152B2

(12) United States Patent
Loutzenhiser

(10) Patent No.: US 11,408,152 B2
(45) Date of Patent: Aug. 9, 2022

(54) APPARATUS FOR BLOWING HOSE

(71) Applicant: Jonathan David Loutzenhiser, O'Neill, NE (US)

(72) Inventor: Jonathan David Loutzenhiser, O'Neill, NE (US)

( * ) Notice: Subject to any disclaimer, the term of this patent is extended or adjusted under 35 U.S.C. 154(b) by 111 days.

(21) Appl. No.: 17/061,151

(22) Filed: Oct. 1, 2020

(65) Prior Publication Data

US 2022/0106777 A1 Apr. 7, 2022

(51) Int. Cl.
*E03B 7/12* (2006.01)
*B08B 9/032* (2006.01)

(52) U.S. Cl.
CPC ..... *E03B 7/12* (2013.01); *B08B 9/0325* (2013.01); *B08B 9/0328* (2013.01)

(58) Field of Classification Search
CPC ..... E03B 7/10; E03B 7/12; Y10T 137/1189; Y10T 137/4259; B08B 9/0328
See application file for complete search history.

(56) References Cited

U.S. PATENT DOCUMENTS 5,488,968 A * 2/1996 Price ..... E03B 7/12 137/59
5,598,867 A * 2/1997 Sullivan ..... E03B 7/10 137/15.16
5,857,480 A * 1/1999 Klein ..... F04B 35/01 239/106
6,206,030 B1 * 3/2001 Barthuly ..... E03B 7/095 137/341
6,237,620 B1 * 5/2001 Ferguson ..... E03B 7/12 137/240
7,198,057 B2 * 4/2007 Zhurin ..... E03B 7/12 137/355.19
10,697,156 B2 * 6/2020 Paul ..... E03B 7/12
2020/0378513 A1 * 12/2020 Kowalski ..... F16K 27/12

* cited by examiner

*Primary Examiner* — Kevin F Murphy

(57) ABSTRACT

Disclosed is an object of the present invention is to provide an apparatus including a housing, a tankless air compressor, a temperature controller, a heating unit, a power supply, and an electrical junction box. The housing includes a first outlet to receive the hose and a second outlet for air intake. The tankless air compressor is configured in the housing for providing air pressure to blow out water through the first outlet in the hose. The tankless air compressor receives air from the second outlet. The temperature controller is configured within the housing to maintain an optimal temperature. The heating unit is configured within the housing attached to the temperature controller for maintaining an above freezing environment. The power supply cable supplies power. The electrical junction box is configured within the housing for distributing the power.

10 Claims, 4 Drawing Sheets

APPARATUS FOR BLOWING HOSE

BACKGROUND OF THE INVENTION

1. Field of the Invention

The present invention generally relates to an outdoor hose blow out apparatus, and more particularly relates to an apparatus for blowing hose for preventing freezing of water.

2. Description of Related Art

A water delivery problem can arise in colder climates where the temperature falls below the freezing temperature of water. For example, farmers need to supply water to livestock and the field, building contractors need to supply water to outdoor worksites and homeowners need water to wash cars and other equipment during winter months, as well as year round in some very cold climates.

Presently, livestock and farm is watered by transporting water from an indoor faucet to remote water troughs in the field. This is done with hand carried buckets or by motor vehicle. This is laborious and time consuming. Prior attempts to provide water in cold weather include wrapping stationary water pipes with heat tape and insulation and providing localized 110 volt electric heaters or gas heaters on water conduits, containers and troughs.

Various solutions are provided to prevent freezing of hoses such as heated hoses, indoor air compressor and gravity draining of hoses. Heated hoses require usage of constant energy to heat hose. Further, heating hoses cannot convert existing hoses in heated hoses.

Products with indoor air compressor cannot be stored outside for instant access, difficult to transport, hard to hook up in cold weather, and unable to operate in very cold climate. Gravity draining of hoses require manual and strenuous operation. Further, gravity draining is time consuming and have serious installation issues.

Therefore, there is a need of an apparatus for blowing hose for preventing freezing of water. The apparatus should be portable, easy to install, and should be able to be used with existing hoses.

SUMMARY OF THE INVENTION

In accordance with teachings of the present invention, an apparatus for blowing hose for preventing freezing of water is provided.

An object of the present invention is to provide an apparatus including a housing, a tankless air compressor, a temperature controller, a heating unit, a power supply, and an electrical junction box. The housing includes a first outlet to receive the hose and a second outlet for air intake.

The tankless air compressor is configured in the housing for providing air pressure to blow out water through the first outlet in the hose. The tankless air compressor receives air from the second outlet. The temperature controller is configured within the housing to maintain an optimal temperature.

The heating unit is configured within the housing attached to the temperature controller for maintaining an above freezing environment. The power supply cable supplies power. The electrical junction box is configured within the housing for distributing the power received from the power supply cable to the tankless air compressor, the temperature controller, and the heating unit.

Another object of the present invention is to provide an apparatus with a check valve configured in the first outlet to prevent backflow through the hose, a sealing to provide waterproofing to the housing, an insulation configured to maintain heat inside the housing, and a switch unit to control the operation of the tankless air compressor.

Another object of the present invention is to provide an apparatus with a temperature monitor configured on the heating unit to record air temperature. The temperature controller automatically controls the operation of the heating unit when the air temperature is nearing the freezing temperature.

Another object of the present invention is to provide an apparatus with a blow-out valve to connect the tankless air compressor to the check valve, and an adaptor configured with the check valve to receive the hose.

DETAILED DESCRIPTION OF DRAWINGS

Embodiments of the invention will now be described with reference to the accompanying Figures, wherein like numerals refer to like elements throughout. The terminology used in the description presented herein is intended to be interpreted in its broadest reasonable manner in accordance with its ordinary use in the art and in accordance with any overt definitions provided below. Arrows not emanating from a numeral indicate a direction of fluid or gas flow.

Figure 1:
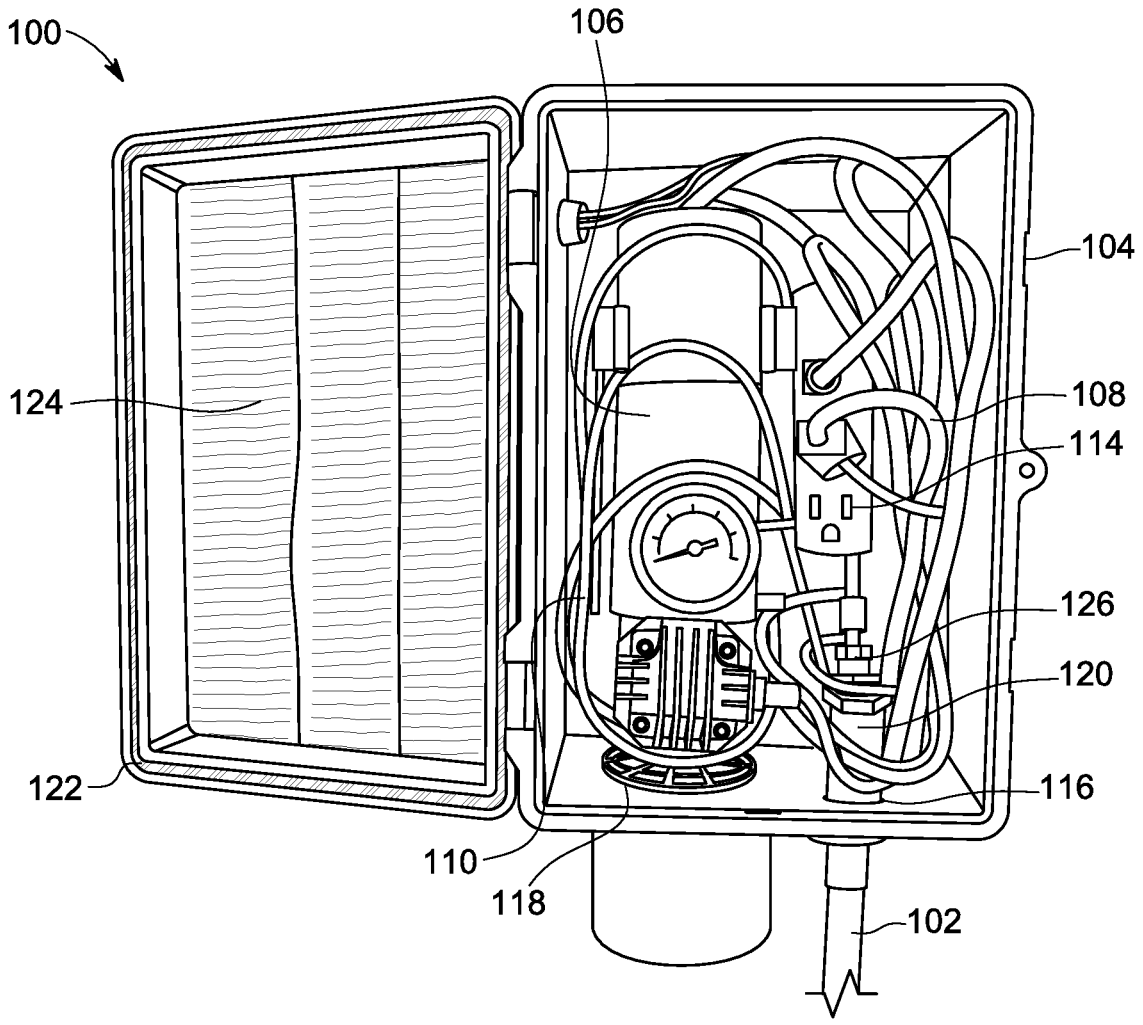
FIG. 1 illustrates a front perspective view of an open apparatus for blowing hose for preventing freezing of water in accordance with an embodiment of the present invention.

FIG. 1 illustrates a front perspective view of an open apparatus 100 for blowing hose 102 for preventing freezing of water in accordance with an embodiment of the present invention. The apparatus 100 includes a housing 104, a tankless air compressor 106, a temperature controller 108, a heating unit 110, a power supply cable (112, shown in FIG. 3) for supplying power, and an electrical junction box 114.

The housing 104 is rectangular box having a hollow compartment to store various components of the apparatus 100. The housing 104 includes a first outlet 116 to receive the hose 102 and a second outlet 118 for air intake. The housing 104 is explained in detail in conjunction with FIG. 3 of the present invention.

The tankless air compressor 106 is configured in the housing 102 for providing air pressure to blow out water through the first outlet 116 in the hose 104. The tankless air compressor 106 receives air from the second outlet 118. In a preferred embodiment of the present invention, the tankless air compressor 106 is 120V husky tankless air compressor. It would be readily apparent to those skilled in the art that various types of tankless air compressor 106 may be envisioned without deviating from the scope of the present invention.

The first outlet 116 is a cylindrical shape opening configured to match with the diameter of the hose. The second outlet 118 is also a cylindrical shape opening configured to match the diameter of the tankless air compressor 106. The second outlet 118 includes a duct to facilitate passing of air. Further, the second outlet 118 allows drainage for condensation buildup. It would be readily apparent to those skilled in the art that various shapes and size of the first outlet 116 and the second outlet 118 may be envisioned without deviating from the scope of the present invention.

The temperature controller 108 is configured within the housing 104 to maintain an optimal temperature. The heating unit 110 is configured within the housing 104 and is attached with the temperature controller 108 for maintaining an above freezing environment.

The above freezing environment ensures that the hose is free of any snow or freezing of water inside the hose. Thus, when the tankless air compressor 106 blows above freezing environment air supply to the hose 102 through the first opening 116, then freezing of water is prevented.

Examples of the temperature controller 108 include but not limited to GardenHOME Valve and Pipe Heating Cable with built-in thermostat (6 Feet), Vivosun Upgrade Reptile Heat Mat and Digital Thermostat Combo. Examples of the heating unit 110 include but not limited heating cable, heating pad (shown in FIG. 2), GardenHOME Valve and Pipe Heating Cable with built-in thermostat (6 Feet), Vivosun Upgrade Reptile Heat Mat and Digital Thermostat Combo etc.

Figure 2:
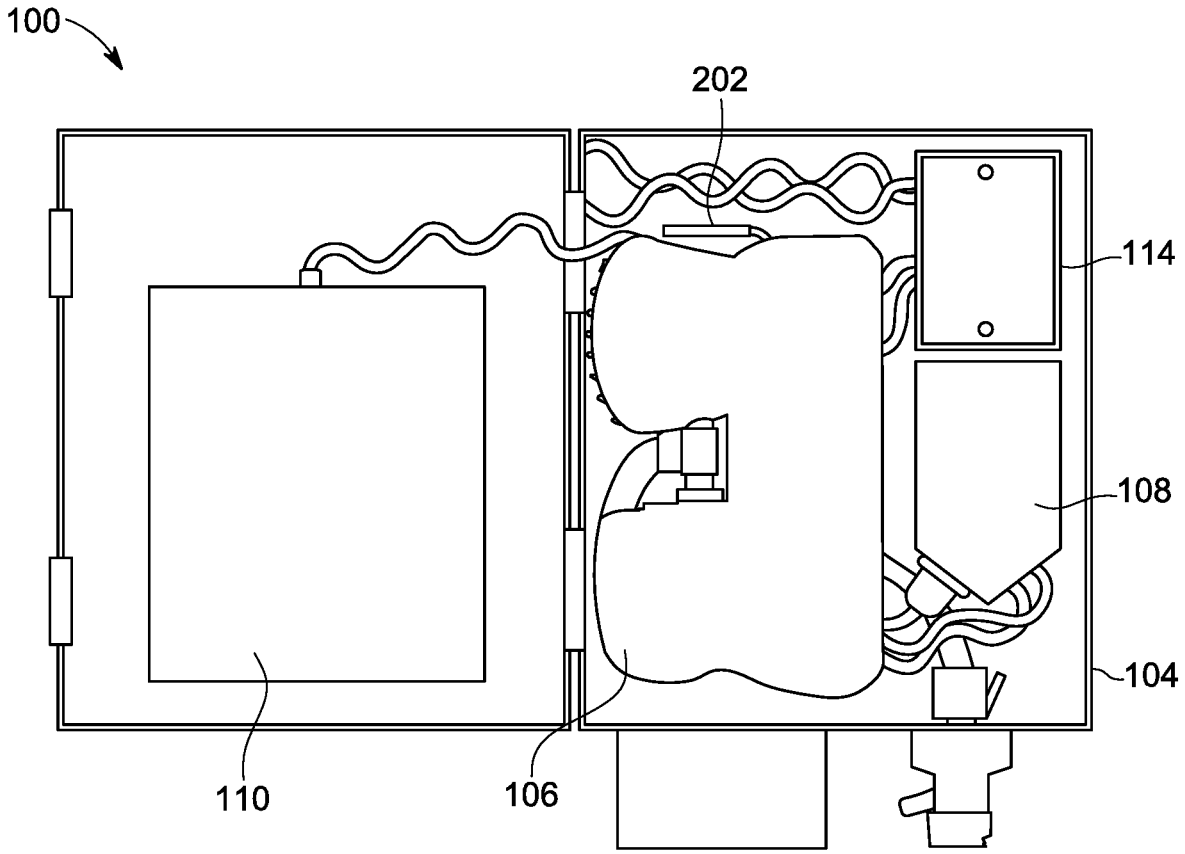
FIG. 2 illustrates a schematic diagram of the apparatus in accordance with alternate embodiment of the present invention.

As shown in FIG. 1, the heating unit 110 is a heating cable which is wrapped around the tankless air compressor 106. Alternate solutions for achieving the same result is shown in FIG. 2 of the invention. The temperature controller 108 and the heating unit 110 is explained in detail conjunction with FIG. 2 of the present invention.

The electrical junction box 114 configured within the housing 104 for distributing the power received from the power supply cable (112, shown in FIG. 3) to the tankless air compressor 106, the temperature controller 108 and the heating unit 110. The electrical junction box 114 are regular circuit units for distributing power.

Examples of the electrical junction box 114 include but not limited to KMC-3 Outlet Power Strip Power Extension Cord. It would be readily apparent to those skilled in the art that various type of electrical junction box 114 may be envisioned without deviating from the scope of the present invention. The electrical junction box 114 is explained in detail in conjunction with FIG. 2 of the present invention.

In another embodiment of the present invention the apparatus 100 further includes a check valve 120 configured in the first outlet to prevent backflow through the hose 102. Examples of the check valve 120 include but not limited to valves from Metal and Brass Company, One-way Check Valve Female Backflow Preventer etc.

In another embodiment of the present invention, the apparatus 100 includes an adaptor (not shown in FIGURES) configured with the check valve 120 to receive the hose 102. Examples of the adaptor include but not limited to a pressure regulator. It would be readily apparent to those skilled in the art that various type of check valve 120 may be envisioned without deviating from the scope of the present invention.

In another embodiment of the present invention the apparatus 100 further includes a sealing 122 to provide waterproofing to the housing, and an insulation 124 configured to maintain heating inside the housing. It would be readily apparent to those skilled in the art that various type of sealing 122 such as rubber sealing, and insulation 124 such as silver layer may be envisioned without deviating from the scope of the present invention.

In another embodiment of the present invention the apparatus 100 further includes a blow-out valve 126 to connect the tankless air compressor 106 to the check valve 120. Examples of the blow-out valve 126 include but not limited to Milton 684-NPT Tank Valve. It would be readily apparent to those skilled in the art that various type of blow-out valve 126 may be envisioned without deviating from the scope of the present invention.

FIG. 2 illustrates a schematic diagram of the apparatus 100 in accordance with alternate embodiment of the present invention. The heating unit 110 is a heating pad used for maintaining an above freezing environment around the tankless air compressor 106 within the housing 104.

The temperature controller 108 further includes a temperature monitor 202 for monitoring the temperature around the tankless air compressor 106. The temperature controller 108 is explained in detail in conjunction with FIG. 1 of the present invention. In a preferred embodiment, the temperature monitor 202 is a thermostat.

However, it would be readily apparent to those skilled in the art that various types of temperature monitor 202 may be envisioned without deviating from the scope of the present invention. The temperature controller 108 automatically controls the operation of the heating unit 110 when the air temperature is nearing the freezing temperature.

For exemplary purposes, the temperature controller 108 identifies that the temperature inside the housing 104 is nearing 0° C. Then the temperature controller 108 automatically starts the operation of heating unit 110 to maintain the above freezing environment within the housing such that the tankless air compressor blows out air to remove any ice/snow layer in the hose.

The electrical junction box 114 is configured within the housing having fixed internal connections with the tankless air compressor 106, the heating unit 110 and the temperature controller 108. The electrical junction box 114 is explained in detail in conjunction with FIG. 1 of the present invention.

Figure 3:
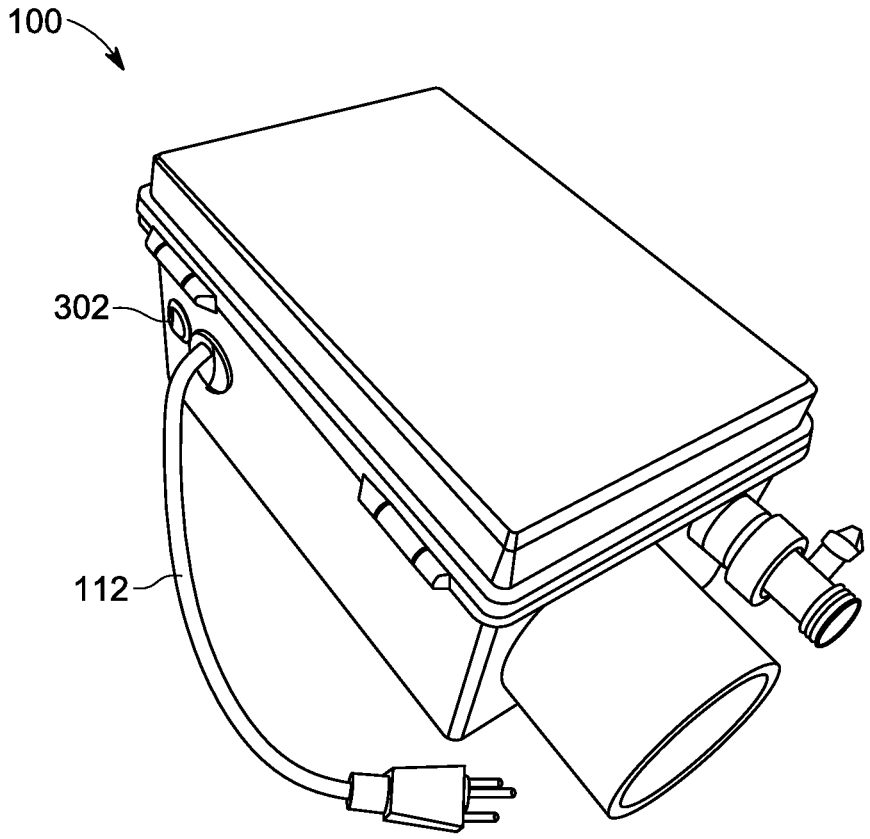
FIG. 3 illustrates another front perspective view of the apparatus in accordance with an embodiment of the present invention.

FIG. 3 illustrates another front perspective view of the apparatus 100 in accordance with an embodiment of the present invention. The apparatus 100 includes a power supply cable 112 to receive power from an AC supply and provides the power to the electrical junction 114.

Further in another embodiment of the present invention, the apparatus 100 includes a switch unit 302 to control the operation of the tankless air compressor 106. The switch unit 302 is a switch configured to on/off the tankless air compressor 106. The switch unit 302 configured to on/off the tankless air compressor 106 depending upon the requirement of a user.

It would be readily apparent to those skilled in the art that various types of power supply cable 112 and switch unit 302 may be envisioned without deviating from the scope of the present invention. Alternatively, those skilled in the art may envision alternative solutions to supply power to the electrical junction box (114, shown in FIG. 1 and FIG. 2) such as wireless means of powering, DC power supply etc., without deviating from the scope of the present invention.

Figure 4:
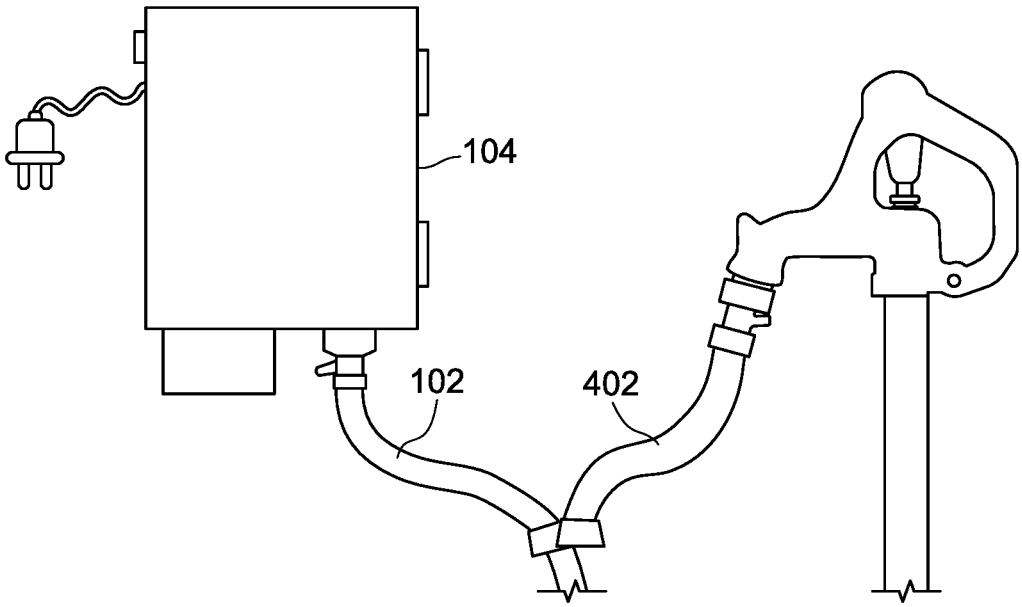
FIG. 4 illustrates a schematic diagram to show process of movement of warm air from the housing through a hose to blow out water from a water hose.

FIG. 4 illustrates a schematic diagram to show process of movement of warm air from the housing 100 through the hose 102 to blow out water from the water hose 402. The hose 102 carries the warm air released from the tankless air compressor 106 configured inside the housing 104. The pressured warm air then blows out the water from the water hose 402. The hose 102 and the water 402 may be connected via Y-shaped distribution hose.

The present invention offers various advantages such as no freezing of water inside the hoses. The present invention maintains above freezing temperature in the hoses that make sure no hoses are choked, which is a common sight during winters. Further, the present invention is configured to be stored outside with a tankless air compressor, resulting in a convenient and easily configurable machine. The present invention further offers and inexpensive, labor-free machine to blow out water from the hoses.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

The invention claimed is:

1. An apparatus for blowing hose for preventing freezing of water, the apparatus comprising:

a housing having a first outlet to receive the hose and a second outlet for air intake;

a tankless air compressor configured in the housing for providing air pressure to blow out water through the first outlet in the hose, the tankless air compressor receives air from the second outlet;

a temperature controller configured within the housing to maintain an optimal temperature;

a heating unit configured within the housing attached to the temperature controller for maintaining an above freezing environment;

a power supply cable to supply power; and an electrical junction box configured within the housing for distributing the power received from the power supply cable to the tankless air compressor, the temperature controller, and the heating unit.

2. The apparatus according to claim 1 wherein the second outlet further allows drainage for condensation buildup.

3. The apparatus according to claim 1 further comprising a check valve configured in the first outlet to prevent backflow through the hose.

4. The apparatus according to claim 3 further comprising a blow-out valve to connect the tankless air compressor to the check valve.

5. The apparatus according to claim 3 further comprising an adaptor configured with the check valve to receive the hose.

6. The apparatus according to claim 1 further comprising a sealing to provide waterproofing to the housing.

7. The apparatus according to claim 1 further comprising an insulation configured to maintain heat inside the housing.

8. The apparatus according to claim 1 further comprising a switch unit to control the operation of the tankless air compressor.

9. The apparatus according to claim 1 further comprising a temperature monitor configured on the heating unit to record air temperature.

10. The apparatus according to claim 9 wherein the temperature controller automatically controls the operation of the heating unit when the air temperature is nearing the freezing temperature.

* * * * *